US005323485A

United States Patent [19]

Josefsson et al.

[11] Patent Number: 5,323,485

[45] Date of Patent: Jun. 21, 1994

[54] PAINT BAKING OVEN HAVING A BRING-UP ZONE UTILIZING SHORT AND MEDIUM WAVE INFRARED LAMPS

[75] Inventors: Leif E. B. Josefsson, Sterling Heights, Mich.; Anders P. A. T. Persson, Vaxjo, Sweden

[73] Assignee: ABB Flakt, Inc., Auburn Hills, Mich.

[21] Appl. No.: 59,633

[22] Filed: May 10, 1993

Related U.S. Application Data

[63] Continuation-in-part of Ser. No. 944,741, Sep. 14, 1992, which is a continuation of Ser. No. 751,718, Aug. 29, 1991, abandoned.

[51] Int. Cl.[5] ..... F27B 9/08

[52] U.S. Cl. ..... 392/417; 219/388

[58] Field of Search ..... 392/411–417; 34/4, 39, 41, 48; 219/388

[56] References Cited

U.S. PATENT DOCUMENTS

| | | | |
|---|---|---|---|
| 3,249,741 | 5/1966 | Mills | 99/386 |
| 3,818,182 | 6/1974 | Linde | 219/388 |
| 4,473,004 | 9/1984 | Wells et al. | 99/386 |
| 4,833,301 | 5/1989 | Furtek | 219/388 |
| 4,894,517 | 1/1990 | Oguri | 219/388 |
| 5,155,335 | 10/1992 | Habaki et al. | 219/388 |

*Primary Examiner*—Bruce A. Reynolds
*Assistant Examiner*—John A. Jeffery
*Attorney, Agent, or Firm*—Harness, Dickey & Pierce

[57] ABSTRACT

A first bring up zone of a camel-back oven utilizes a plurality of short and/or medium wave infrared lamps to raise the component temperature up to a desired level. Once within the paint baking oven, the component enters into the bring up zone where a computer activates the requisite number of infrared lamps at the proper intensity to achieve the desired component temperature. While the infrared lamps are activated, inlet air is directed over the lamps to prevent them from overheating. The invention allows for smoother car finishes by preventing bubbling and pops and raises the component temperature more quickly than conventional dark radiation panels.

9 Claims, 2 Drawing Sheets

PAINT BAKING OVEN HAVING A BRING-UP ZONE UTILIZING SHORT AND MEDIUM WAVE INFRARED LAMPS

This application is a continuation-in-part of U.S. patent application Ser. No. 07/944,741 filed Sep. 14, 1992, which is a continuation of U.S. patent application Ser. No. 07/751,718 filed Aug. 29, 1991, now abandoned.

BACKGROUND OF THE INVENTION

I. Technical Field

This invention relates to bring up zones for paint baking ovens. More particularly, the invention relates to a method and apparatus for distributing infrared radiation within this bring up zone of a camel-back paint baking oven to increase the temperature of components passing therethrough.

II. Discussion

Paint baking ovens are used throughout the manufacturing industry to bake the paint or coating applied to various articles such as automobile components. Such paint baking ovens often have conveyors or similar devices for bringing the component to be baked into the paint baking oven and then carrying the component through the various sections or zones of the paint baking oven. Generally, the first section or zone of a paint baking oven is known as a bring up zone. In a camel back paint baking oven this bring up zone has traditionally been positioned in the "hump" of such an oven, or, as shown in U.S. Pat. No. 5,155,335 to Habaki et al., in the oblique ramp connecting the oven entrance to the hump portion. While the component being baked is contained in this bring up zone, a heat source is activated which brings the component's body temperature to a desired level. It is well known in the industry that providing a relatively even body temperature over the entire component gives rise to a more consistent baking which, in turn, results in a more desirable finish.

Traditionally, dark radiation panels contained within the hump portion of the oven have been used as the heat source within paint baking oven bring up zones to obtain a relatively even temperature over the component body. The purpose of the radiant heat bring-up zone is to "skin" the paint coating prior to subjecting it to convection heating in a subsequent holding zone—i.e. to remove any stickiness at the outermost layer of the coating. By the time the painted object leaves such a bring-up zone, most of any solvents in the coating have been driven off by radiant heat. Although some success has been achieved through the use of dark radiation panels as a means of increasing the component's body temperature, it is difficult to control the amount of heat generated over specific areas of the component through the use of dark radiation panels. For example, if the component to be paint baked is an automobile component, it has been discovered that dark radiation panels are a less effective way of heating certain parts such as the roof, bonnet, side doors, wheel houses and other heavy parts because they contain inaccessible hidden surfaces.

Another drawback in using dark radiation panels within the bring up zone is the excessive amount of time necessary to increase the temperature of larger components to the desired level.

Until recently, none of the art known to the Applicant utilized infrared lamps within the bring up zone of a camel back oven to quickly increase the component's temperature to a desired level. U.S. Pat. No. 5,155,335 which issued Oct. 13, 1992 to Habaki discloses an infrared heater disposed within the oblique portion of the oven adjacent the elevated horizontal heating chamber. A severe drawback in disposing the infrared heat source within the oblique section of the oven is the likelihood of damage to the infrared heating source from exposure to the excessive heat generated by the elevated horizontal heating chamber. Typically, the convection heating which occurs within the elevated horizontal portion of a camel back oven is carried out at extremely high temperatures, much higher than the infrared lamps are capable of withstanding. Although Habaki discusses the use of a infrared heating source within the oblique portion of a camel back oven, there is no teaching, either express or implied of disposing a heating source such as infrared lamps within the lower horizontal portion of a camel-back oven to thereby function as a bring up zone. Further, none of the art presently known to the Applicant utilize any type of heating source within the lower horizontal portion of a camel-back oven.

SUMMARY OF THE INVENTION

Accordingly, the invention provides a paint baking oven having a camel back design, wherein a first bring up zone is located below the adjoining convection air paint baking oven section. The first bring up zone includes a lower substantially horizontal portion positioned below the elevated hump portion of the oven which houses the convection air heating section. The components to be baked enter the paint baking oven on a conveyor and are led through the first bring up zone. The component's body temperature is increased while within the lower substantially horizontal portion of this bring up zone by a heat source to begin the paint baking process. Preferably the heat source is a radiant heat sources, although other sources are contemplated. After the component's body temperature has been increased to the desired level, the conveyor transfers the component into the oblique portion of the oven and on to the elevated convection air drying section of the oven where the component is baked, with the paint coating undergoing a chemical reaction.

Heating means are provided within the lower substantially horizontal portion of the bring up zone which are operative to increase the temperature of the component contained therein. The heating means generally comprise a plurality of centrally directed infrared lamps extending from a frame member which selectively projects radiation onto the component as it passes through the leading end of the bring up zone. One of the key features associated with using infrared lamps is that each lamp can be controlled to emit radiation at a selected efficiency between 0–100%. By controlling the efficiency of each lamp, compensation for differences such as size, shape and the amounts and types of coatings used on the component can be effected.

A feature of the invention is to provide a radiation source which evaporates solvents from inside a paint layer. This internal heating eliminates bubbling and/or pops from occurring in the paint or coating as the component temperature is increased.

A further feature of the invention is the relative ease by which the painted object's surface temperature is evenly regulated over certain irregularly shaped portions thereof, due to the use of individually controlled infrared lamps.

Yet another feature of the present invention is to extend the useful life of the infrared lamps by protecting them from the excessive heat generated within the elevated convection air heating portion of the paint baking oven.

BRIEF DESCRIPTIONS OF THE DRAWINGS

The objects and features of the invention will become apparent from a reading of a detailed description taken in conjunction with the drawings, in which.

DETAILED DESCRIPTION OF THE PREFERRED EMBODIMENT

Figure 1:
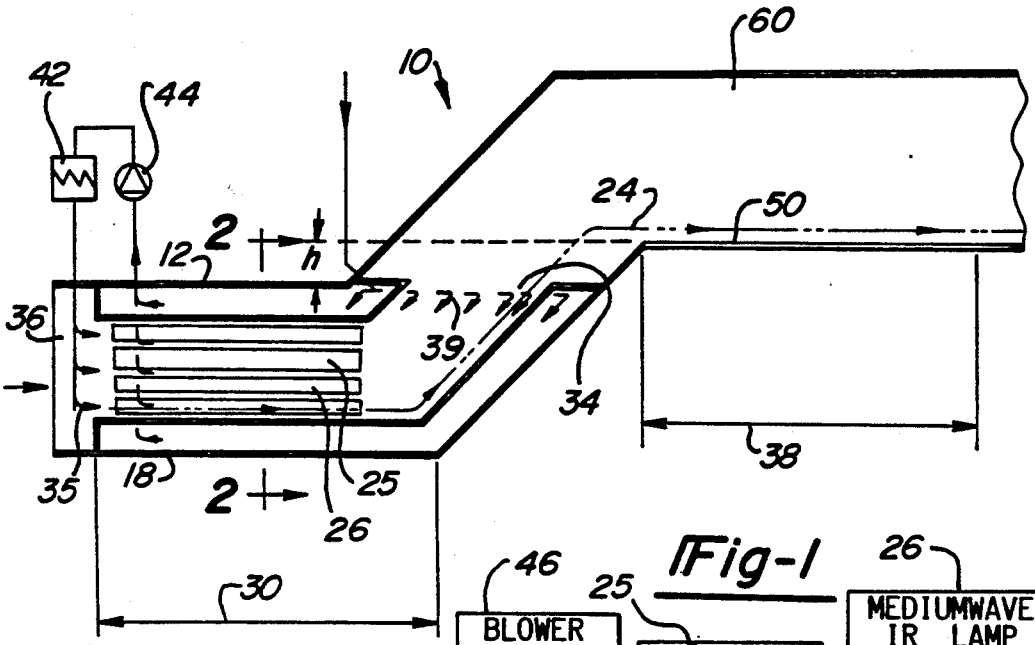
FIG. 1 is a cross-sectional side view of a first bring up zone arranged in accordance with the principles of the invention.
Figure 2:
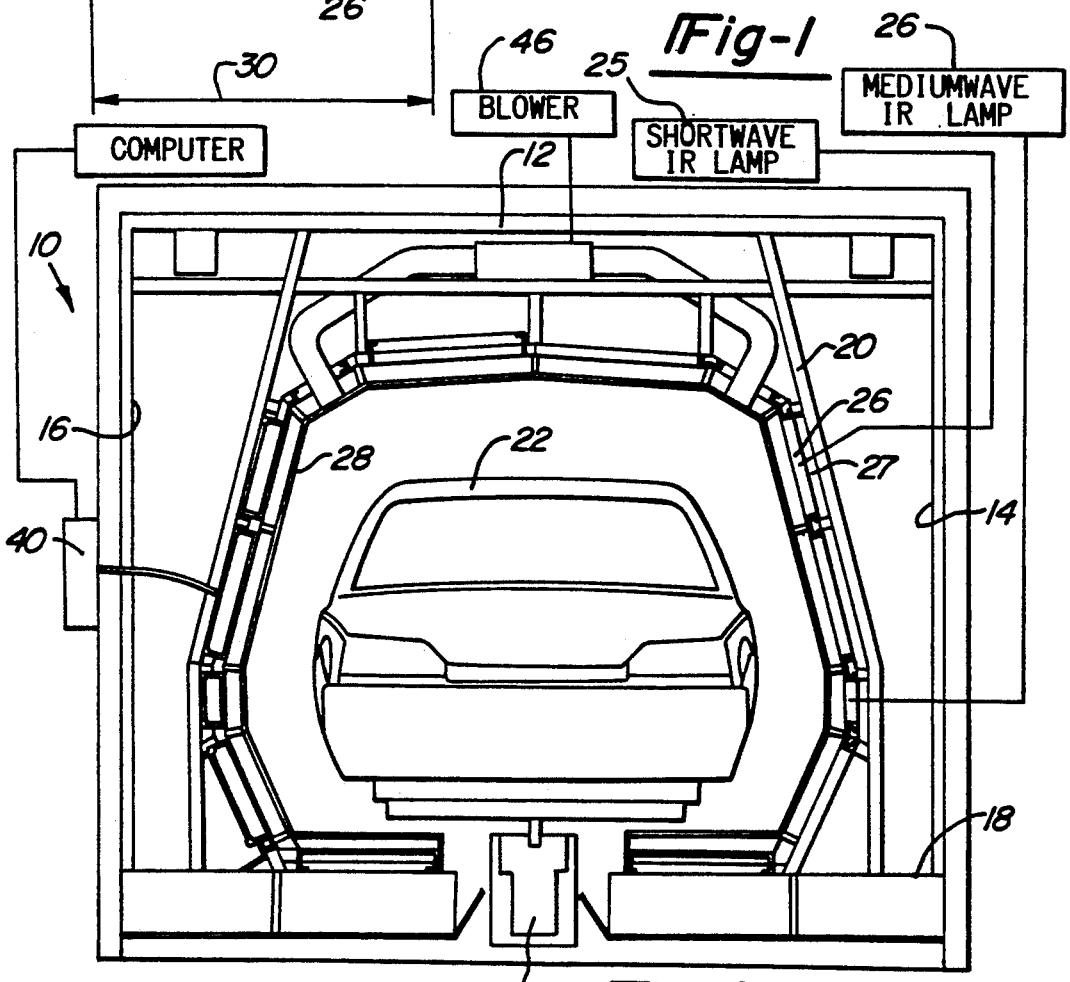
FIG. 2 is a lateral-sectional view taken at line 2—2 of FIG. 1 showing the bring up zone incorporating infrared lamps.
Figure 3:
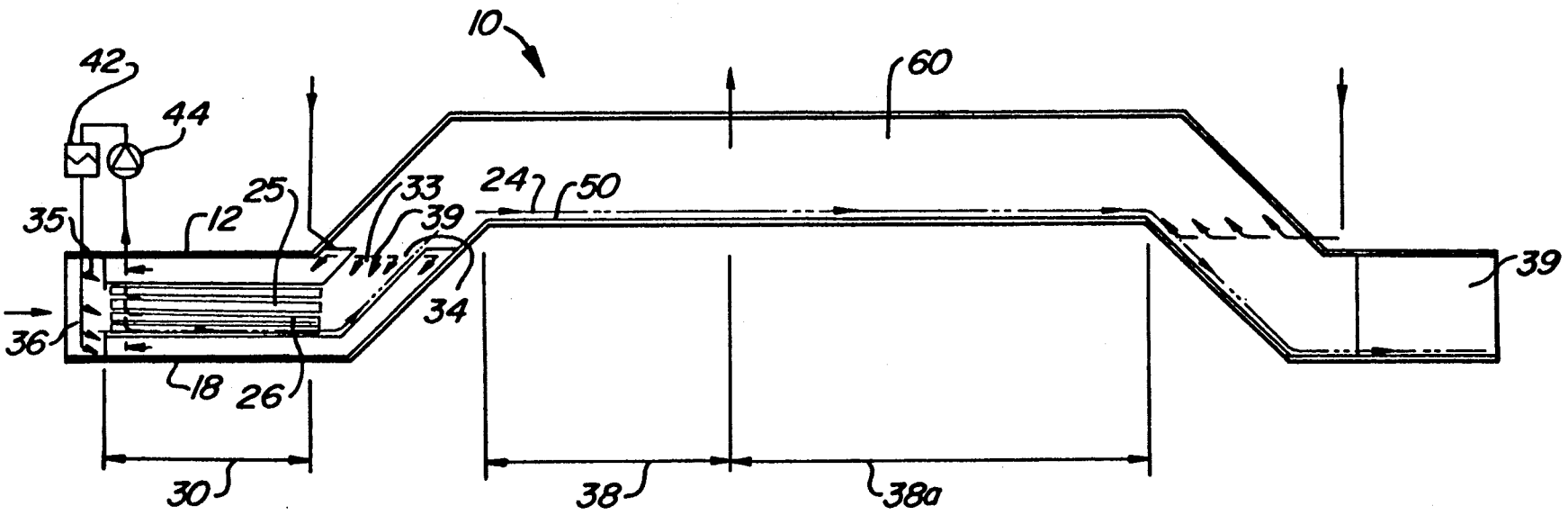
FIG. 3 is a cross-sectional side view of a camel-back paint baking oven having exhaust means located between a bring up zone and a convection air holding zone.

With reference to FIGS. 1, 2 and 3, a paint baking oven 10 includes an outer ceiling 12 and a floor 18 interconnected by two side walls 14 and 16. The paint baking oven 10 is a elongated tunnel having first and second end sections 36 and 37 which are separated approximately at the middle point of the paint baking oven 10 by a parallel hump 60 having a bottom surface or floor 50 located at least 0.5 meters above the ceiling 12 of the two end portions. This height differential of at least 0.5 meters between the first end section and the contiguous raised middle section of the camel-back paint baking oven 10 is essential to the proper operation of the present invention. The height differential is designated as in h FIG. 1.

The articles to be baked move along a conveyor 24 from the sealed entrance end 36 to the sealed exit end 37 throughout the elongated tunnel along a path of travel parallel to the longitudinal axis of the zone or section through which the article is passing. The paint baking oven 10 is used to bake articles which are generally designated by the numeral 22. Although an automobile component has been chosen for demonstrative purposes, it will be understood by those skilled in the art that the present invention may be used for other types of articles in addition to automobile components 22.

The component 22 initially enters the camel-back paint baking oven 10 on a conveyor 24 through an air sealed silhouette located at the entrance end 36 of the paint baking oven 10. Component 22 advances within the paint baking oven 10 upon the conveyor 24 through a first bring up zone 30. This first bring up zone 30 lies within a first substantially horizontal portion located along a first end of the oven. As noted, the camel back oven according to the teachings of the present invention is designed such that the floor 50 of the hump portion 60 is located at least 0.5 meters above the ceiling 12 of the horizontal bring up zone 30, as designated by reference letter h in FIG. 1.

Bring up zone 30 includes a heating system disposed therewithin for increasing the temperature of the component 22 to a desired level. The heating system preferably comprises a combination of short wave infrared lamps 25 and medium wave infrared lamps 26, both of which are contained within reflective lamp housings 27 which assist in directing the infrared radiation waves at the component 22. Each of the lamp housings 27 extend inwardly toward the component 22 as it passes through the bring up zone 30 from a frame member 20. Short wave infrared lamps 25 are generally operational over a range of approximately 0.8–2.0 microns and middle wave lamps 26 are generally operational over a range of approximately 2.0–4.0 microns. Ideally, the infrared lamps are operated in a range of between 1.2 and 2.4 microns.

Located between the infrared lamps 25 and 26 and the component 22 passing through the bring up zone 30 is an air tight quartz glass wall 28 which protects the lamps from dust, solvents and resins which might be present in the paint baking oven 10. Quartz glass wall 28 also assists in isolating the infrared lamps 25 and 26 from the hot air surrounding the painted object in the paint baking oven 10.

The infrared lamps are controlled through time pulsing or TRIAC'S by a computer 40 which make it possible to light specific lamps at specific intensities to accommodate for the variances in the painted surface of the component 22 as it passes through bring up zone 30.

The bring up zone 30 also includes an air inlet system for bringing air into the interior of bring up zone 30. The inlet air flows into the trailing end 34 of the bring up zone 30 as designated by arrows 39 through horseshoe or U-shaped inlets 33 where the air is directed downward towards the entrance end 36 of the bring up zone 30. The inlet air serves to cool the infrared lamps 25 and 26 which are susceptible to overheating. Once the inlet air approaches the entrance end 36 of the bring up zone 30 it is circulated back into the zone 30 by a draft of air designated by arrows 30 introduced by blower 46 by entering the leading end 36 of the bring up zone 30 where it can be used to assist in the paint baking process. The air drawn through filtration system 44 to remove dust and evaporated solvents can then be reintroduced into the oven by blower 46 to provide a synergistic effect with the air entering the leading end of the oven 10.

The height differential h between the floor 50 of the hump portion 60 and the ceiling 12 of the first bring up zone 30 also assists in keeping the infrared lamps cool. As a result of this height differential h the excessively hot convection air contained within the hump portion 60 is precluded from contacting the infrared lamps, thus prolonging the useful life of the infrared lamps. The heating convection air from the hump portion 60 is almost entirely maintained within the hump portion 60 and the top half of the oblique portion of the oven. Any minor amounts of heated air generated by convection heating within the hump portion 60 which may seep into the bottom half of the oblique portion would be dissipated by the air entering at inlets 33.

With further reference to FIGS. 1 and 2, the bring up zone 30 operates in the following manner. Component 22 initially enters the paint baking oven 10 on conveyor 24 through an air sealed silhouette (not shown) located at the entrance end 36 of the paint baking oven 10. Once inside the paint baking oven 10 the component 22 advances along the conveyor 24 at a rate of approximately 10–20 ft./minute along a longitudinal path of travel parallel to the longitudinal axis of the particular bring up zone portion.

The heating requirements for the particular component are programmed into a computer 40 which is used to individually control the intensity and efficiency of the infrared lamps 25 and 26 used to bring the component's temperature to the desired level. The computer 40 is programmed to take into account various factors such as the size, shape and the material make up of the component 22 being heated. The computer program also accounts for the absorption factor of the paint which is applied to the component 22. For example, top coat lines of silver metallic paint have the lowest absorption factor and black solids have the highest absorption factor. The computer 40 is, therefore, programmed to operate the infrared lamps 25 and 26 on high power at 100% efficiency when the component 22 is coated with silver metallic paint and to reduce the power and/or the efficiency of the infrared lamps 25 and 26 through time pulsing or TRIAC'S for component 22 coated with paints possessing a higher absorption factor.

As the components 22 pass through the lower substantially horizontal portion of the bring up zone 30, the infrared lamps 26 are activated by the computer 40, according to the control specifications entered therein, to heat the component 22 to the desired level prior to a more intense baking within the convection air holding zones such as zone 38 of FIG. 3. The radiation emitted by the infrared lamps passes through the quartz wall 28 and is directed upon component 22 until the desired component temperature is attained.

Once the component has passed through the bring up zone, the component advances through the remaining oven sections.

One advantage is using infrared lamps 25 and 26 is that the radiant heat penetrates the outer paint surface and bakes the coating from the inside out, heating the innermost layers progressively outwardly toward the skin dried outermost layer. It should be noted however that heat sources other than infrared lamps or panels are contemplated.

The invention has been described with reference to a detailed description of a preferred embodiment given for the sake of example only. The scope and spirit of the invention are to be determined by the appended claims.

What is claimed is:

1. A camel-back oven for receipt of an article to be baked at preselected temperatures comprising:

first and second end sections, said first end section being substantially horizontal and including a bring up zone having radiant heating means therein for increasing the temperature of the article to be baked; and a hump section coupled to and positioned between the first and second end sections and having a central substantially horizontal section with a bottom surface positioned above a top surface of the bring up zone, said hump section including means for convection heating.

2. The camel-back oven of claim 1, wherein the radiant heating means comprises a plurality of infrared lamps.

3. The camel-back oven of claim 2, wherein said infrared lamps further comprise a combination of short and middle wave infrared lamps positioned upon a frame member located within said bring up zone and arranged such that said lamps face inward toward the center of said bring up zone.

4. The camel-back oven of claim 1, further comprising stored program control means operative to control a temperature of the heating means.

5. The camel-back oven of claim 3, wherein said short wave infrared lamps operate in a range of between 0.8 and 2.0 microns.

6. The camel-back oven of claim 3, wherein said middle wave infrared lamps operate in a range of between 2.0 and 4.0 microns.

7. The camel-back oven of claim 3, wherein said infrared lamps are operated in a range of between 1.2 and 2.4 microns.

8. The camel-back oven of claim 2, wherein said infrared lamps are provided with reflector means which direct the radiation produced by said lamps toward articles as they pass through said bring up zone.

9. The camel-back oven of claim 1, wherein the bottom surface of the hump section is positioned at least 0.5 meters above the top surface of the bring up zone.

* * * * *